US008448942B2

(12) United States Patent
Otani et al.

(10) Patent No.: US 8,448,942 B2
(45) Date of Patent: May 28, 2013

(54) RECORDING MEDIUM STACKER AND RECORDING APPARATUS WITH STORED SECOND STACK MEMBER

(75) Inventors: Aya Otani, Matsumoto (JP); Shinichiro Yoshikawa, Matsumoto (JP); Satoshi Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 166 days.

(21) Appl. No.: 13/102,126

(22) Filed: May 6, 2011

(65) Prior Publication Data

US 2011/0285077 A1 Nov. 24, 2011

(30) Foreign Application Priority Data

May 19, 2010 (JP) ..... 2010-115415

(51) Int. Cl.
*B65H 31/20* (2006.01)

(52) U.S. Cl.
CPC ..... *B65H 31/20* (2013.01)
USPC ..... 271/213

(58) Field of Classification Search
USPC ..... 271/213
See application file for complete search history.

(56) References Cited

U.S. PATENT DOCUMENTS

| | | | | |
|---|---|---|---|---|
| 6,231,043 | B1 | 5/2001 | James, III et al. | |
| 2006/0159500 | A1* | 7/2006 | Takagi et al. | 399/405 |
| 2009/0267283 | A1* | 10/2009 | Mizuguchi | 271/162 |
| 2011/0278789 | A1* | 11/2011 | Otani et al. | 271/207 |

FOREIGN PATENT DOCUMENTS

| | | | |
|---|---|---|---|
| JP | 2002-356263 | A | 12/2002 |
| JP | 2003-095518 | A | 4/2003 |
| JP | 2003-524563 | A | 8/2003 |
| JP | 2005-205648 | A | 8/2005 |
| JP | 2008-303000 | A | 12/2008 |
| JP | 2009-286574 | A | 12/2009 |

* cited by examiner

*Primary Examiner* — Gerald McClain
(74) *Attorney, Agent, or Firm* — Workman Nydegger

(57) ABSTRACT

A second stacker is provided with base-end projection portions and leading-end projection portions that protrude outward in the width direction from the second stacker from both sides of the second stacker at the base end of the second stacker in the pull-out direction thereof. A first stacker is provided with guide rails on which the stated projection portions slide when the second stacker is pulled out; contact portions that do not make contact with and allow the leading-end projection portions to pass when the second stacker is pulled out but prevent the base-end projection portions from passing; and a support portion that supports the leading-end projection portions when the base-end projection portions are in contact with the contact portions.

6 Claims, 7 Drawing Sheets

RECORDING MEDIUM STACKER AND RECORDING APPARATUS WITH STORED SECOND STACK MEMBER

CROSS-REFERENCE TO RELATED APPLICATIONS

This application claims the benefit of priority to Japanese Patent Application No. 2010-115415, filed May 19, 2010, the contents of which are hereby incorporated by reference in their entirety.

BACKGROUND

1. Technical Field

The present invention relates to recording medium stackers that stack recording media discharged from a recording apparatus and recording apparatuses provided with such recording medium stackers.

2. Related Art

Recording apparatuses that record predetermined images (including text, graphics, and so on) by applying a recording agent (such as a liquid) onto a recording medium (such as paper) are known. Such recording apparatuses typically include recording medium stackers (called simply "stackers" hereinafter) that support and stack recording media discharged to the outside of the apparatus. In order to make this type of stacker more compact when the recording apparatus is not in use, a pull-out structure is employed, where the support surface that supports the discharged recording media is formed using multiple components and the surface area of the support surface is increased by pulling one of the components out from other components.

For example, JP-A-2003-95518 proposes a stacker in which an approximately horizontally-oriented support surface (stacker surface) is formed in a connected manner, where a first pull-out portion is pulled out from a stacker base portion and a second pull-out portion is pulled out from the first pull-out portion. According to this stacker, a discharged recording medium can be moved smoothly along the approximately horizontal support surface formed in a connected manner by the stacker base portion, the first pull-out portion, and the second pull-out portion.

However, because the stacker disclosed in JP-A-2003-95518 is formed so that the support surface extends in an approximately horizontal direction using the multiple components, there is a problem in that the footprint of the stacker in the horizontal direction increases when the stacker is in use. Accordingly, a configuration in which the support surface, which is formed in a connected manner in which one component is pulled out from another component, is slanted partway through has been recently proposed, as exemplified by the configuration disclosed in JP-A-2008-303000. In other words, the discharged paper stacker apparatus disclosed in JP-A-2008-303000 includes a leading end stacker that is pulled out from an intermediate stacker, at which point the tip area of the leading end stacker is held on the intermediate stacker in a raised, slanted orientation by a holding mechanism portion.

Incidentally, with the discharged paper stacker apparatus disclosed in JP-A-2008-303000, the holding mechanism portion is configured of a locking convex portion formed in a flexible base end area of the leading end stacker on the opposite side thereof as the pull-out direction, a locking projection formed in the intermediate stacker and formed in the base end area of the intermediate stacker in the pull-out direction, and a locking groove being formed in the leading end area of the intermediate stacker in the pull-out direction. In other words, the configuration is such that when the leading end stacker is pulled out, the flexible base end area thereof flexes, allowing the locking convex portion to pass over the locking projection, and the locking convex portion and locking groove interlock in the pull-out direction after the leading end stacker has been pulled out. Accordingly, when a load is placed upon the leading end stacker due to the weight of the stacked recording media in a pulled-out state, in principle, a force is exerted on the base end area of the leading end stacker (and specifically, the area where the locking convex portion that has interlocked with the locking groove is formed). Accordingly, because the base end area of the leading end stacker is made flexible in order to allow for bending during pull-out, there is the risk that deformation, breakage, and so on will occur due to loads placed thereupon; therefore this configuration has been unsuitable for stackers in which particularly large loads are placed on the holding mechanism portion.

SUMMARY

An advantage of some aspects of the invention is to provide a recording medium stacker capable of stacking discharged recording media in a stable manner while having good load-bearing properties, and to provide a recording apparatus that includes such a recording medium stacker.

A recording medium stacker according to an aspect of the invention supports and stacks a recording medium discharged from a recording apparatus, and includes: a first stack member provided with a first support surface capable of supporting the recording medium; and a second stack member that is stored within the first stack member and can be pulled out of and pushed into the first stack member, and that is provided with a second support surface capable of supporting the recording medium when the second stack member has been pulled out of the first stack member and is in use. The second stack member includes, on both side surfaces in the width direction that is the direction that intersects with the pull-out direction from the first stack member and follows the second support surface: base-end projection portions, provided in the side surfaces, that protrude from the base end in the pull-out direction of the second stack member outward in the width direction; and leading-end projection portions, provided further toward the leading end in the pull-out direction than the base-end projection portions, that protrude outward in the width direction at a shorter length than the base-end projection portions. The first stack member includes: guide rails along which the projection portions slide during the pull-out; contact portions that allow the leading-end projection portions to pass in no contact state during the pull-out but prevent the passage of the base-end projection portions by contacting thereto; and a support portion that supports the leading-end projection portions when the base-end projection portions have made contact with the contact portions.

According to this configuration, it is not necessary for the base end area of the second stack member to bend when the second stack member is pulled out from the first stack member; therefore, the base end area, to which a force is applied when the second stack member has received a load in the pulled-out state, is provided with a resilience that ensures good load-bearing properties. Accordingly, the second stack member has good load-bearing properties, and thus the discharged recording medium can be stacked in a stable manner even in the case where the second stack member takes on a heavy load, such as when recording media having a large size are supported.

In a recording medium stacker according to another aspect of the invention, the support portion is a sloped surface that guides the leading-end projection portions to a higher position in the gravitational direction than the base-end projection portions when the base-end projection portions have made contact with the contact portions.

According to this configuration, when the second stack member has been pulled out from the first stack member, the second stack member is held in a tilted orientation so that the leading-end projection portions are positioned higher than the base-end projection portions, and thus the discharged recording media can be stacked in a stable manner.

In a recording medium stacker according to another aspect of the invention, a first interlocking portion is provided in the first stack member on the side opposite to the first support surface; a second interlocking portion capable of interlocking with the first interlocking portion is provided in the second support surface of the second stack member; and in the state where the movement of the second stack member in the pull-out direction is prevented by the base-end projection portions making contact with the contact portions, the first interlocking portion and the second interlocking portion interlock at a location that is closer to the base end in the pull-out direction than the leading-end projection portions so that the movement of the second stack member in the push-in direction is prevented.

According to this configuration, in the case where the second stack member has taken on a load, a rotational force in the direction that increases the degree of interlock between the first interlocking portion and the second interlocking portion is applied, with the leading-end projection portions, which are forward in the pull-out direction, acting as the rotational center thereof. Accordingly, for example, even if there is a gap (looseness) between the projections and the guide rails, it is possible to maintain, in a stable manner, the tilted state of the second stack member that has been pulled out from the first stack member.

In a recording medium stacker according to another aspect of the invention, the first interlocking portion is provided in the central area in the width direction of the first support surface, and the second interlocking portion is provided in the central area in the width direction of the second support surface.

According to this configuration, because the first interlocking portion and the second interlocking portion interlock at the central area in the width direction, even if the second stack member is pulled out at a tilt relative to the pull-out direction during pull-out, a stable interlock can be achieved because the influence of the tilt at the central area in the width direction is low. Accordingly, a stable interlock can be achieved, which makes it possible to carry out the pull-out operation in a smooth manner. Conversely, in the case of the push-in operation, the influence of the slope in the central area is low, and thus the interlock at the central area can be released in a stable manner. Accordingly, the push-in operation can be carried out in a smooth manner.

In a recording medium stacker according to another aspect of the invention, a groove extending lengthwise in the pull-out direction is provided in the second support surface of the second stack member; a protrusion capable of sliding along the groove is provided in the first stack member, in a location thereof that corresponds to the location of the groove in the width direction; and during the pull-out and the push-in, the second stack member moves while the protrusion is slid along the groove.

According to this configuration, during the pull-out and push-in of the second stack member, the movement of the second stack member in the width direction is regulated by the protrusion interlocking with the groove in the width direction, which intersects with the pull-out and push-in direction. Accordingly, looseness in the width direction occurring when the second stack member is pulled out or pushed in can be suppressed, which makes it possible to pull out or push in the second stack member in a smooth manner.

A recording apparatus according to another aspect of the invention includes a recording unit that records onto a recording medium; a discharge unit that discharges the recording medium that has been recorded onto; and the stated recording medium stacker.

According to this configuration, a recording apparatus that includes a recording medium stacker whose support surface has good load-bearing properties can be provided.

BRIEF DESCRIPTION OF THE DRAWINGS

The invention will be described with reference to the accompanying drawings, wherein like numbers reference like elements.

FIG. 3A is a perspective view from below, and FIG. 3B is a partial bottom view seen from below the circular dash-line area indicated by the arrow IIIB in FIG. 3A.

FIG. 4A is a perspective view from above, and FIG. 4B is a cross-sectional view taken along the IVB-IVB line in FIG. 4A.

FIG. 5A is a plan view of a stacker, FIG. 5B is a cross-sectional view taken along the VB-VB line in FIG. 5A, FIG. 5C is a cross-sectional view taken along the VC-VC line in FIG. 5A, and FIG. 5D is a partial bottom view seen from below the oval dash-line area indicated by the arrow VD in FIG. 5A.

FIG. 6A is a perspective view from above, FIG. 6B is a plan view from directly above, and FIG. 6C is a cross-sectional view taken along the VIC-VIC line shown in FIG. 6B.

DESCRIPTION OF EXEMPLARY EMBODIMENTS

Hereinafter, an ink jet printer (also called simply a "printer" hereinafter), which is one type of a recording apparatus provided with a recording medium stacker, that embodies the invention will be described using the drawings. Note that in the following embodiments, the descriptions will be given assuming that the gravitational direction is the downward direction, the direction opposite to the gravitational direction is the upward direction, the pull-out direction of the stacker is the forward direction, the push-in direction of the stacker is the backward direction, and the direction horizontally orthogonal to the pull-out direction of the stacker is the horizontal direction/width direction.

First Embodiment

Figure 1:
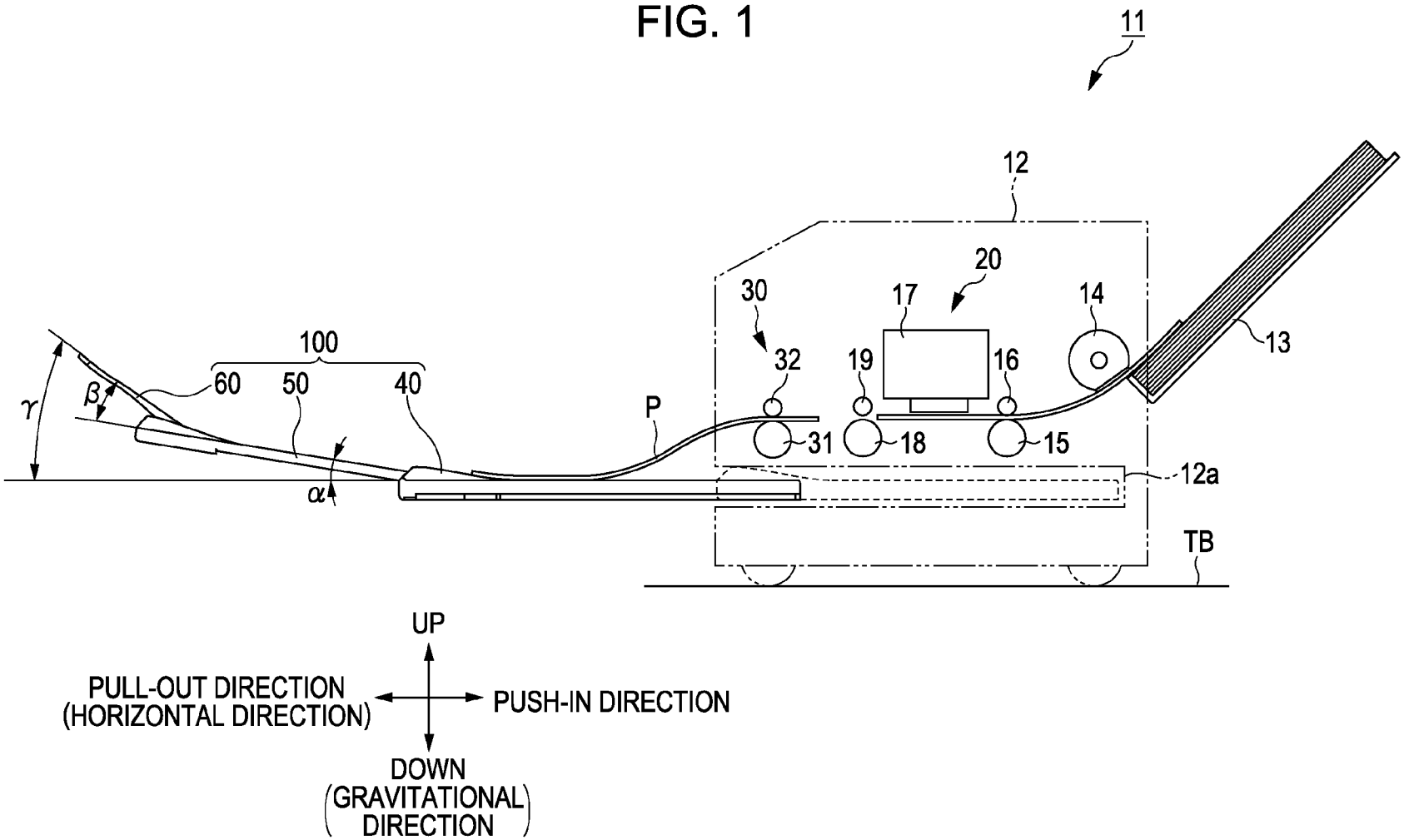
FIG. 1 is a schematic view illustrating the overall configuration of a printer according to a first embodiment.

As shown in FIG. 1, a printer 11 according to this embodiment has an approximately box-shaped casing 12. A recording unit 20 that records a predetermined image onto paper P serving as a recording medium by ejecting ink serving as a liquid, and a discharge unit 30 that discharges the paper P that has passed through the recording unit 20 to the outside of the casing 12, are provided within the casing 12. Furthermore, a paper supply tray 13 is provided in a tilted state on the outside of the casing 12.

The paper P is gathered in a stacked state in the paper supply tray 13, and the paper P is supplied to the recording unit 20 within the casing 12, one sheet at a time, by a supply roller 14 that is rotationally driven by a driving unit (not shown).

The recording unit 20 includes a recording head 17 that ejects ink onto the paper P, a paper feed roller 15, a slave roller 16, a discharge roller 18, and a slave roller 19. Note that a platen (not shown), serving as a support platform for the paper P onto which ink has been ejected, is provided below the recording head 17. The paper feed roller 15 is rotationally driven by a driving unit (not shown), and pinches the paper P supplied from the paper supply tray 13 with the slave roller 16, transporting the paper P between the recording head 17 and the platen.

The recording head 17 forms an image by ejecting ink onto predetermined locations on the paper P that has been transported upon the platen by the paper feed roller 15. Note that the recording head 17 ejects ink while moving back and forth in the width direction of the paper P that intersects with the transport direction of the paper P (that is, the direction that is orthogonal to the paper surface in FIG. 1), or ejects ink in a state in which the recording head 17 does not move and is instead provided so as to span the entire width of the paper P in the width direction of the paper P. Furthermore, the paper P is transported continuously or intermittently in the downstream direction, which is the direction of the discharge unit 30, in accordance with the ejection of the ink from the recording head 17.

The discharge roller 18 is also rotationally driven by a driving unit (not shown), and transports the paper P toward the discharge unit 30 by pinching the paper P that has passed between the recording head 17 and the platen with the slave roller 19.

The discharge unit 30 includes a discharge roller 31 and a slave roller 32. The discharge roller 31, which is rotationally driven by a driving unit (not shown), pinches, with the slave roller 32, the paper P transported by the rotational driving of the discharge roller 18, and discharges the paper P to the outside of the casing 12.

The printer 11 is provided with a stacker (recording medium stacker) 100 that holds and stacks the discharged paper P. The stacker 100 includes a first stacker 40 serving as a first stack member, a second stacker 50 serving as a second stack member, and a third stacker 60 serving as a third stack member. The third stacker 60 is provided so as to be capable of being stored within the second stacker 50, and the second stacker 50 is provided so as to be capable of being stored within the first stacker 40. Finally, the first stacker 40 is provided so as to be capable of being stored within a storage unit 12*a* of the printer 11, in a state in which the third stacker 60 is stored within the second stacker 50 and the second stacker 50 is stored within the first stacker 40.

The storage unit 12*a* is provided in a location corresponding to the bottom side of the casing 12 when the printer 11 has been placed on a placement platform TB such as a table, and is provided so that a storage space for storing the stacker 100 is approximately parallel to the bottom of the casing 12. Furthermore, a slide mechanism (not shown) is provided within the storage space of the storage unit 12*a*, and the slide mechanism can be used to pull the stacker 100 (the first stacker 40) forward from the storage unit 12*a*, which is the pull-out direction, as well as to push the stacker 100 (the first stacker 40) backward from that position, which is the push-in direction. Normally, the stacker 100 is stored within the storage unit 12*a* when not in use.

When the stacker 100 is in use, where the paper P is being stacked, first, the first stacker 40 is pulled out from the storage unit 12*a* in the forward direction, which corresponds to the discharge direction of the paper P, thus forming a first support surface SP1 (see FIG. 2) capable of supporting the paper P in front of the discharge unit 30. Next, the second stacker 50 is pulled out from the first stacker 40 in the forward direction, thus forming a second support surface SP2 that continues from the first support surface SP1. At this time, when the second stacker 50 has been pulled out from the first stacker 40, the second stacker 50 is held in a tilted orientation, in which the leading end of the second support surface SP2 is tilted upward by a holding mechanism portion HK (see FIGS. 5B and 5C), mentioned later. Furthermore, the third stacker 60 forms a third support surface SP3, which is tilted upward from the leading edge of the second stacker 50, by rotating the third stacker 60 central to the leading edge (front edge portion) of the second stacker 50.

In this embodiment, as shown in FIG. 1, an angle $\alpha$ for the upward slope that reduces the discharge speed of the paper P is formed between a base-side support surface SP1*a* in the first support surface SP1 of the first stacker 40 (see FIG. 2A) and the second support surface SP2 of the second stacker 50 (see FIG. 2A). Likewise, an angle $\beta$ for the upward slope that reduces the discharge speed of the paper P is formed between the second support surface SP2 of the second stacker 50 and the third support surface SP3 of the third stacker 60 (see FIG. 2A). As a result, an angle $\gamma$ ($=\alpha+\beta$) that is greater than the angle $\alpha$ is formed between the base-side support surface SP1*a* of the first support surface SP1 in the first stacker 40 that is furthest toward the base in the discharge direction of the paper P, and the third support surface SP3 of the third stacker 60 that is located furthest toward the leading edge. Accordingly, with the stacker 100 according to this embodiment, the multiple support surfaces SP1 (SP1*a*, SP1*b*), SP2, and SP3 are formed so that support surfaces that are tilted in a progressive manner are connected in the pull-out direction of the stacker 100, which is also the discharge direction of the paper P.

Furthermore, in this embodiment, the storage unit 12*a* is provided so as to be approximately parallel to the bottom surface of the casing 12 in the printer 11. Normally, the printer 11 is installed in a state in which the bottom surface of the casing 12 is approximately horizontal, and by doing so, the storage space within the storage unit 12*a* extends along an approximately horizontal direction. As a result, the pull-out direction of the first stacker 40 that is pulled out from the storage unit 12*a* is an approximately horizontal direction, and thus the base-side support surface SP1*a* of the first support surface SP1 that initially supports the discharged paper P follows the horizontal direction.

Figure 2:
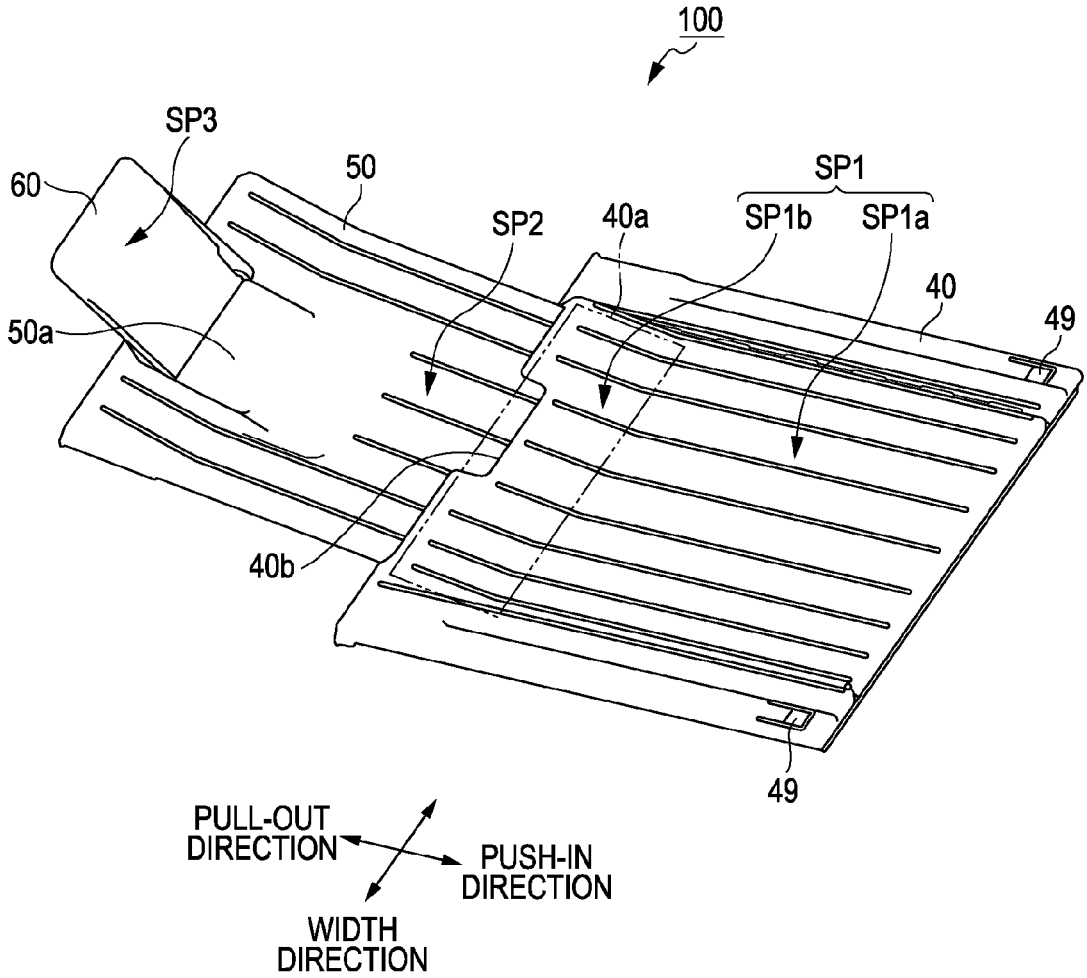
FIG. 2 is a perspective view illustrating a recording medium stacker according to an embodiment.

Next, the structure of the stacker 100 according to this embodiment will be described in detail with reference to the drawings. FIG. 2 is a perspective view illustrating a state in which the stacker 100 is in use, or in other words, in which the first stacker 40, the second stacker 50, and the third stacker 60, each of which has an approximately square shape when viewed from above, have been completely pulled out from the storage unit 12*a*. Note that the casing 12 and the paper supply tray 13 have been omitted from this diagram.

As shown in FIG. 2, the first support surface SP1, which is capable of supporting the paper P, is provided on the top surface of the first stacker 40. This first support surface SP1 is configured so as to include the base-side support surface SP1*a*, which forms a planar shape at the base end of the first stacker 40 in the pull-out direction, and a leading edge-side support surface SP1*b*, which forms a planar shape whose leading edge in the pull-out direction is raised upward. In the first support surface SP1 of the first stacker 40, the base-side support surface SP1*a* is formed as the primary planar surface, spanning in the pull-out direction, that initially supports the discharged paper P. Likewise, the leading edge-side support surface SP1*b* is formed so as to have approximately the same width as that of the base-side support surface SP1*a* at a forward region 40*a* of the first stacker 40 that is forward in the pull-out direction, and is formed so as to connect smoothly to the leading end of the base-side support surface SP1*a* by the forward region 40*a* tilting upward relative to the pull-out direction. In other words, the base-side support surface SP1*a* and the leading edge-side support surface SP1*b* in the first support surface SP1 form a delivery area that intersects at the angle α; however, there is no joint in the delivery area, and a radial curve is provided instead, with the two support surfaces SP1*a* and SP1*b* being smoothly connected so as to form a connected curved support surface.

As shown in FIG. 2, a cut-out 40*b* for making it easier to pull out the second stacker is formed in the middle of the width direction of the end of the first stacker 40 in the pull-out direction. Furthermore, surfaces that are slightly lower than the base-side support surface SP1*a* in the downward direction, which is the thickness direction or the vertical direction, are formed on both sides of the first stacker 40 in the width direction thereof that intersects with the pull-out direction, in order to increase the torsional strength of the first stacker 40. Meanwhile, stoppers 49 that regulate the movement of the first stacker 40 in the pull-out direction by interlocking with projections (not shown) provided within the storage unit 12*a*, so that the first stacker 40 cannot pull out completely from the storage unit 12*a* of the printer 11, are formed in these lower surfaces on the opposite end in the pull-out direction. As shown in FIG. 2, on the respective surfaces of at least the base-side support surface SP1*a* and the leading edge-side support surface SP1*b* of the first support surface SP1 according to this embodiment, multiple band-shaped ribs that protrude slightly from the surfaces are formed so as to extend lengthwise in the pull-out direction and at predetermined intervals in the width direction, in order to reduce friction with the paper P that moves along the first support surface SP1.

Meanwhile, as shown in FIG. 2, the second support surface SP2, which supports the paper P, is provided in the pulled-out second stacker 50. This second support surface SP2 is formed as the main planar surface of the second stacker 50 in the pull-out direction. Furthermore, in this embodiment, the holding mechanism portion HK, which holds the second stacker 50 in a tilted orientation, is provided so that when the second stacker 50 has been pulled out from the first stacker 40, the leading edge-side support surface SP1*b* of the first support surface SP1 and the second support surface SP2 are approximately parallel, or in other words, so that the two surfaces extend in the same direction and form what is essentially the same planar surface.

Furthermore, a storage depression 50*a*, into which the third stacker 60 is folded in an overlapping state, is provided in the second stacker 50, in a forward region in the pull-out direction thereof and in the center in the width direction thereof. Shaft holes 50*d* for axially supporting shaft portions (not shown) protruding outward in the width direction from both sides of the base portion of the third stacker 60 in a freely-pivotable state are formed on the respective inner side surfaces of the storage depression 50*a* on both sides thereof in the width direction. By pivoting the third stacker 60 from the stored orientation, in which the third stacker 60 overlaps with the second stacker 50, in an opening direction (rotation in the clockwise direction shown in FIG. 1), so that the third support surface SP3 in the storage depression 50*a* follows the second support surface SP2, the third stacker 60 is pulled out into an opened orientation in which the leading end thereof tilts upward, as shown in FIG. 1 and FIG. 2. When the third stacker 60 has been pulled out to the opened orientation in this manner, the third support surface SP3, which has a narrower surface in the width direction than the second support surface SP2, forms a connection with the second support surface SP2 in which the third support surface SP3 is tilted further upward, relative to the second support surface SP2, toward the front of the discharge direction of the paper P.

Note that the forward region of the second stacker 50 in the pull-out direction is formed so that the surface thereof has a tilted surface, tilted upward slightly more than the second support surface SP2 relative to the pull-out direction, in order to add to the structural strength of the second stacker 50 and form a structure in which the third stacker 60 can be stored by pivoting the third stacker 60. However, note that this tilted surface is formed so that when the second stacker 50 is pushed into and stored within the first stacker 40, the tilted surface does not interfere with the bottom surface of the first stacker 40 that opposes the second stacker 50. Furthermore, as shown in FIG. 2, in this embodiment, on the surface of the second support surface SP2 aside from the storage depression 50*a*, multiple band-shaped ribs that protrude slightly from the surface are formed at predetermined intervals in the width direction and extending lengthwise in the pull-out direction, in order to reduce friction with the paper P that moves along the second support surface SP2.

Next, the holding mechanism portion HK will be described. The holding mechanism portion HK according to this embodiment is configured as a structure provided in both the first stacker 40 and the second stacker 50. Accordingly, first, the structure in the first stacker 40 will be described, and then the structure in the second stacker 50 will be described. Then, the configuration of the holding mechanism portion HK will be described using a state in which the second stacker 50 has been pulled out from the first stacker 40.

Figure 3A:
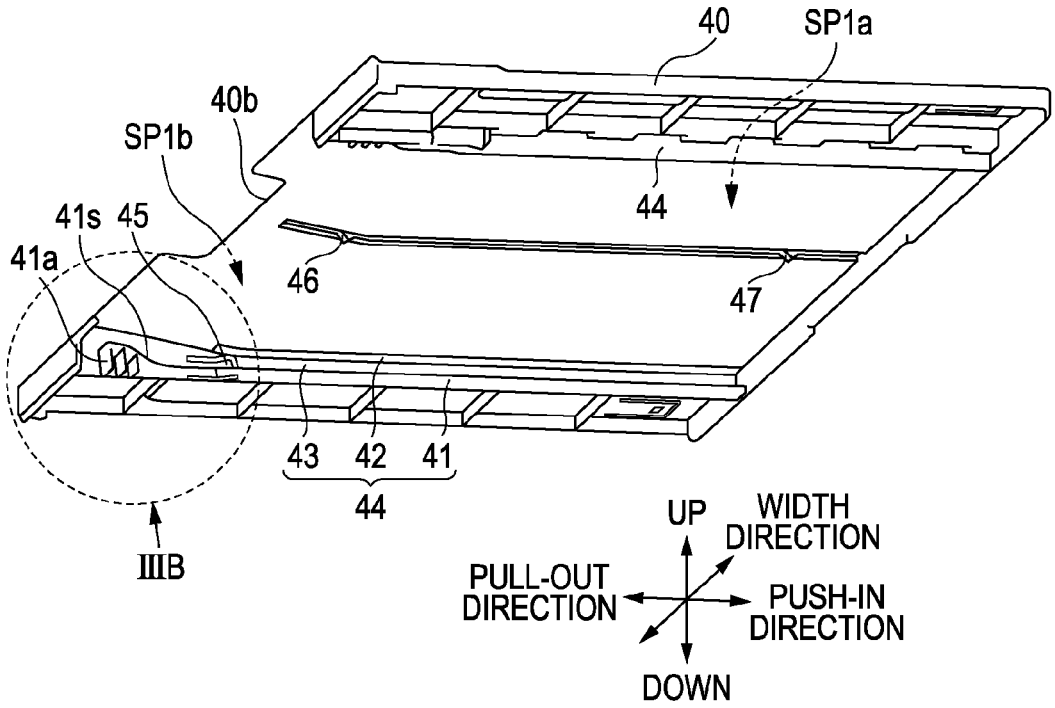
FIGS. 3A and 3B are diagrams illustrating a first stacker, where

First, the structure in the first stacker 40 will be described with reference to FIGS. 3A and 3B. FIG. 3A is a perspective view, viewing the first stacker 40 at an angle from below, whereas FIG. 3B is a partial bottom view of the area in FIG. 3A indicated by the arrow IIIB (that is, the circular dash-line area) seen from below.

Figure 3B:
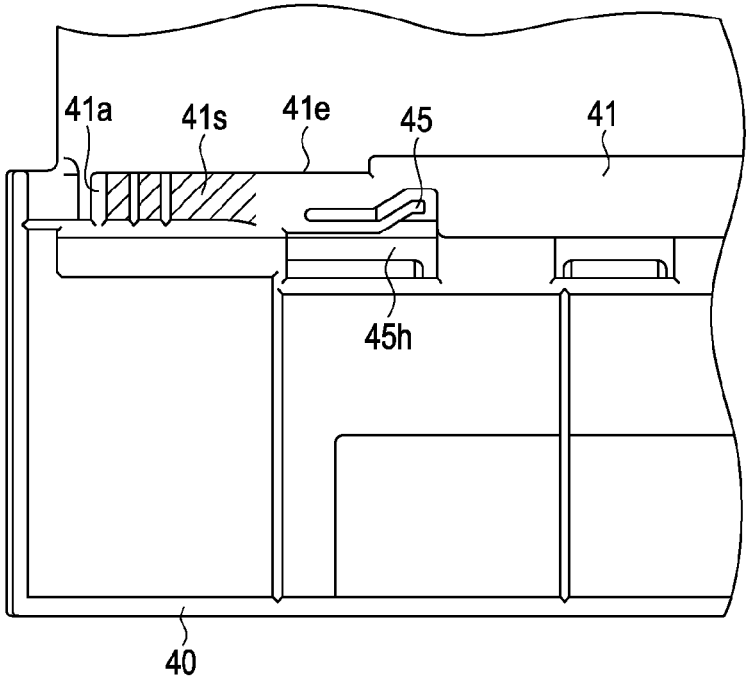

As shown in FIGS. 3A and 3B, approximately band-shaped guide plates 41, each having a flat surface that is parallel to the base-side support surface SP1*a* on the top surface side of the first support surface SP1, are provided, in locations that are on the outer sides of the rear surface of the first stacker 40 in the width direction, so as to extend from the base end (following end) of the first stacker 40 in the pull-out direction to locations that correspond approximately to the center of the leading edge-side support surface SP1*b* on the top surface side. In addition, an approximately band-shaped guide surface 42 that extends parallel to the guide plates 41 is provided on the lower surface (the rear surface) of the first stacker 40 so as to oppose the guide plates 41 from above in the thickness direction. Guide ribs 43 having wall surfaces in the upper and lower directions are provided along the pull-out direction so as to connect the guide plates 41 and the guide surface 42 to each other on the outer sides of their band shapes in the width direction. In this embodiment, concave-shaped, horizontally-oriented guide rails 44 having openings that point toward the center in the width direction are configured by the guide plates 41, the guide surface 42, and the guide ribs 43. The guide rails 44 are formed as a pair having a predetermined interval therebetween in the width direction of the first stacker 40 that essentially corresponds to the dimensions of the second stacker 50 in the width direction, and are configured so as to have a region that overlaps, in a planar manner, with part of the second stacker 50 in the width direction. Accordingly, the second stacker 50 is capable of being pulled out, pushed in, and so on along the guide rails 44. Note that shaft-shaped projections 51 and 52 (mentioned later; see FIG. 4A, FIG. 4B) provided on both side surfaces of the second stacker 50 slide within these respective guide rails 44.

In each of the guide plates 41, a rising sloped portion 41*s* (in FIG. 3B, the area on the opposite side of the hatched area in the orthogonal direction of the paper) is formed so as to continue from the planar portion of the guide plates 41 that extends from the base end of the guide plates 41 to the leading end of the guide plates 41, so that a leading edge region 41*e*, having a predetermined length, rises toward the front in the pull-out direction and approaches the leading edge-side support surface SP1*b*, which is sloped upward on the upper surface side. Reinforcing ribs 41*a* (three, in FIGS. 3A and 3B), for suppressing the guide plate 41 (the sloped portion 41*s*) from deforming (bending) in the downward direction, are formed in the spatial region formed below the sloped portion 41*s* due to the leading edge region 41*e* of the guide plate 41 rising. Note that in each of the guide plates 41, the leading edge region 41*e* that forms this sloped portion 41*s* is formed at a narrower width than the other areas (the planar areas) of the guide plate 41 through cutouts on both sides of the guide plate 41 in the width direction, so that a sufficient space for the second stacker 50 to pass during pull-out and push-in along the guide rails 44 can be secured. Doing so makes it possible to store the second stacker 50 within the first stacker 40, with the second stacker 50 passing between the pair of sloped portions 41*s* without interference and the portions of the second stacker 50 that overlap in a planar manner with the guide plates 41 in the width direction (that is, the shaft-shaped projections 51 and 52) moving while being supported.

Furthermore, in a location of the guide rib 43 that is before the area corresponding to the sloped portion 41*s* (in the opposite direction of the pull-out direction), a contact portion 45, configured of a cantilever-shaped elastic portion formed in a bent shape by having its surrounding area cut out, is formed so that its leading edge area angles outward from the wall surface of the guide rib 43, and inward in the width direction, by a predetermined amount. In this embodiment, this contact portion 45 is formed so that its bent-shaped leading side is flexible, by providing a cut in the constituent member of the guide rail 44 (that is, the guide rib 43). Note that in order to form the contact portion 45 configured of a cantilever-shaped elastic portion using die cutting, an opening 45*h* (see FIG. 3B) for die cutting is formed in a location of the first stacker 40 that corresponds to the contact portion 45.

Figure 5A:
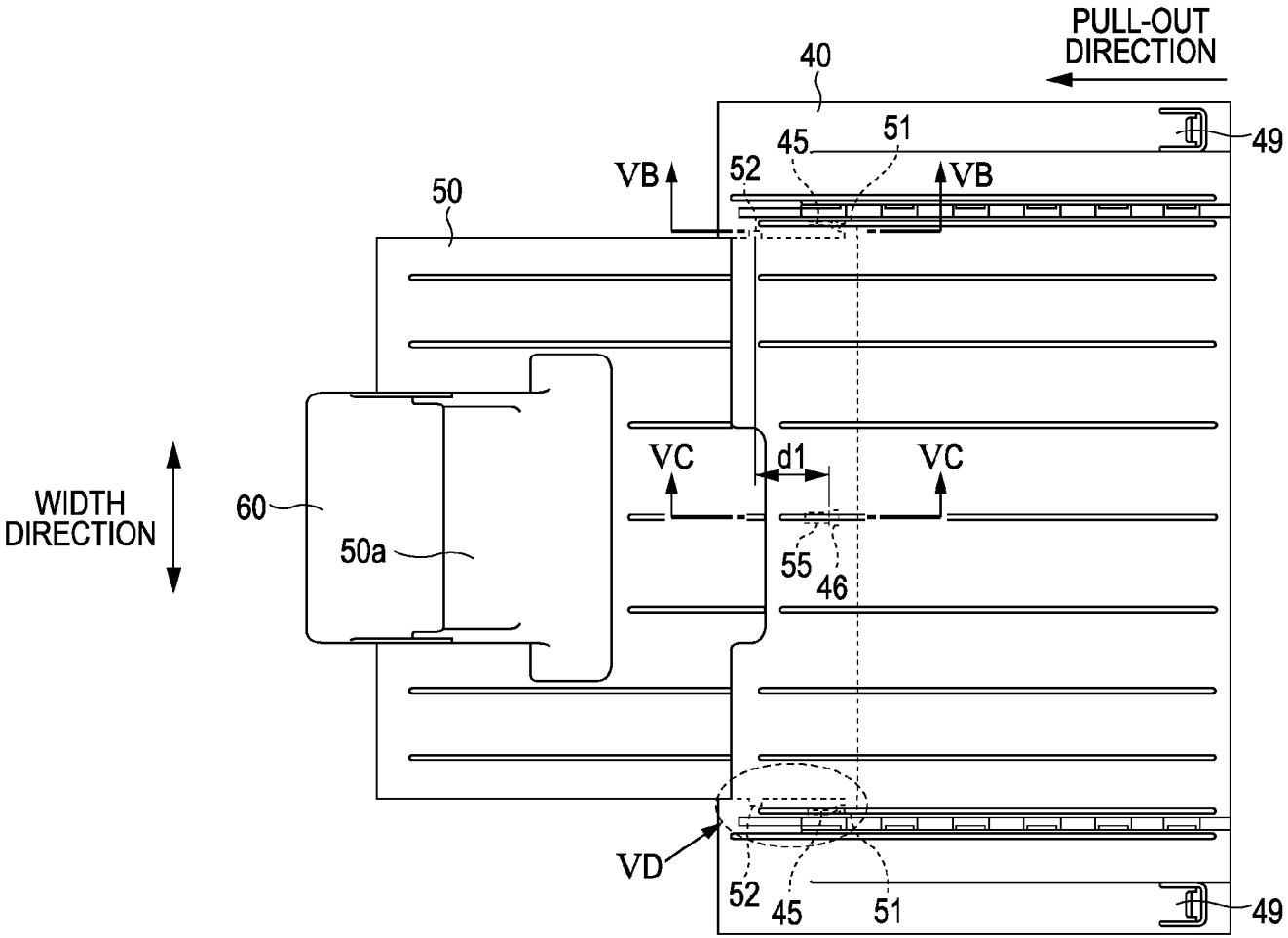
FIGS. 5A, 5B, 5C, and 5D are descriptive diagrams illustrating a holding mechanism portion, where
Figure 5B:
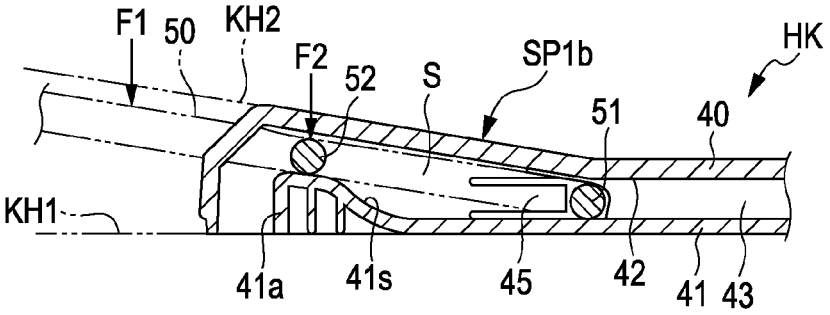

Furthermore, in this embodiment, the sloped portion 41*s*, the contact portion 45, and so on are formed within the spatial region that corresponds to the rear side of the leading edge-side support surface SP1*b* of the first support surface SP1. In other words, these portions are formed within a spatial region S, which, when the first stacker 40 is viewed from above, is located within the outer boundaries of the first stacker 40 and between an imaginary plane KH1 that contains a bottom surface parallel to the base-side support surface SP1*a* in the first stacker 40 (that is, the lower surface of the guide plates 41) and an imaginary plane KH2 that contains the leading edge-side support surface SP1*b*, as shown in FIG. 5B. Accordingly, the rear surface side of the first stacker 40 has an essentially flat bottom surface shape in which nothing protrudes in the downward direction from the first stacker 40 that includes the guide plates 41, including the multiple reinforcing ribs 41*a* that are formed.

Furthermore, as shown in FIG. 3A, a first projection (first interlocking portion) 46 and a second projection 47 are formed in what is essentially the center of the first stacker 40 in the width direction, in the rear surface thereof that is on the side opposite to the first support surface SP1. A single first projection 46 is provided in a location, toward the front in the pull-out direction, that corresponds to the location in the pull-out direction of the contact portion 45 that is cut out from the guide rib 43, whereas a single second projection 47 is provided in a location, toward the rear in the pull-out direction, that corresponds to the location in the pull-out direction that the stoppers 49 are provided in on the front surface side. Accordingly, the second projection 47 is formed in a location where, when the second stacker 50 is pushed into and stored on the rear surface side of the first stacker 40, the second projection 47 makes contact in an essentially flat manner in the pull-out direction with a projection (second interlocking portion) 55 (see FIGS. 4A and 4B) provided in the following end of the surface of the second stacker 50, in the center of the width direction thereof.

Figure 4A:
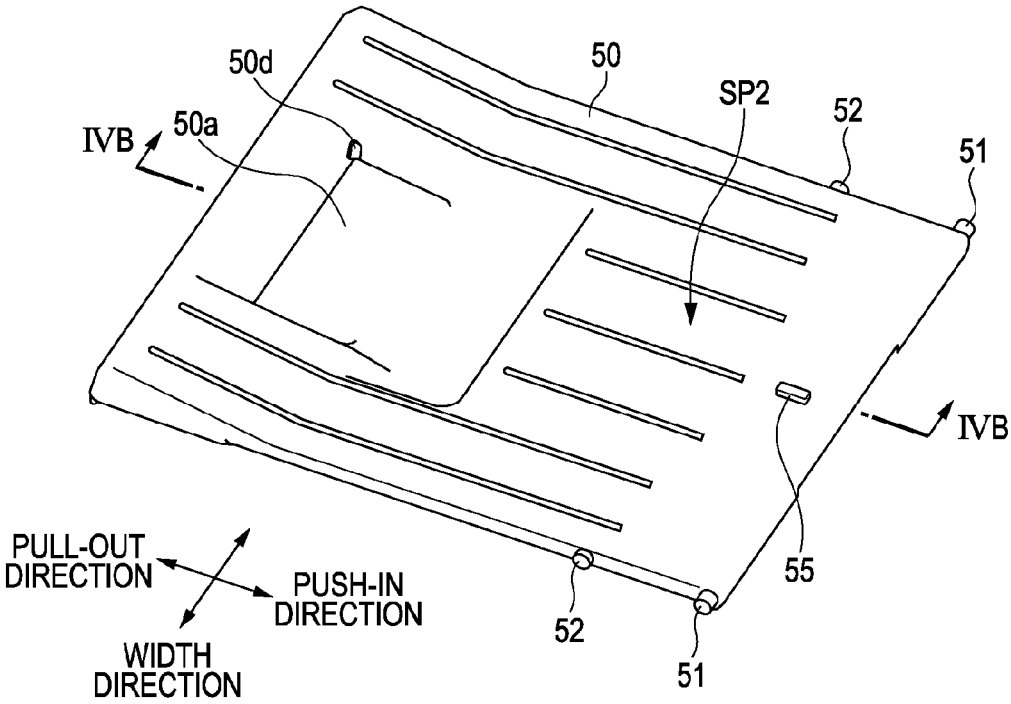
FIGS. 4A and 4B are diagrams illustrating a second stacker, where

Next, the structure of the second stacker 50 will be described with reference to FIGS. 4A and 4B. FIG. 4A is a perspective view of the second stacker 50 seen from above, whereas FIG. 4B is a cross-sectional view taken along the IVB-IVB line shown in FIG. 4A.

Figure 4B:
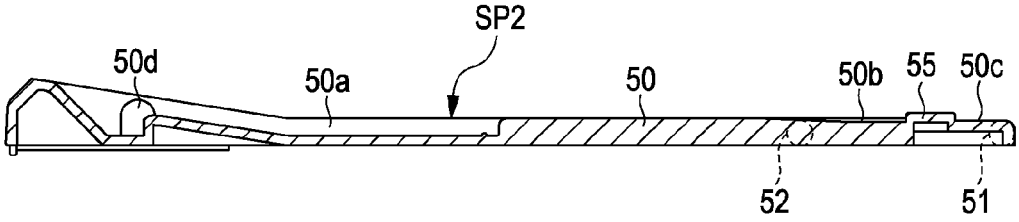

As shown in FIGS. 4A and 4B, two each of the shaft-shaped projections 51 and 52 are formed, protruding outward in the width direction, from both side surfaces of the second stacker 50 in the width direction, which is the direction that is orthogonal to the pull-out direction and that follows the second support surface SP2. In other words, the longer base end shaft-shaped projections 51 are erected from the side surfaces at the base end (following end) in the pull-out direction, and the shorter leading end shaft-shaped projections 52 are erected from locations that are a predetermined distance toward the leading end in the pull-out direction from the base end shaft-shaped projections 51 (specifically, the distance between what is approximately the center of the top surface of the sloped portion 41*s* and the leading edge of the contact portion 45). To rephrase, the base end shaft-shaped projections 51 extend further outward from the side surfaces than the leading end shaft-shaped projections 52. As mentioned earlier, these two shaft-shaped projections 51 and 52 are guided by and slide along the pair of guide rails 44 provided in the first stacker 40 when the second stacker 50 is pulled out from the first stacker 40.

Furthermore, a projection 55 that extends outward relative to the planar area of the second stacker 50 is formed in the second stacker 50, in a location that is toward the following end of the second stacker 50 in the pull-out direction and that is approximately in the center of the surface of the second stacker 50 in the width direction. As shown in FIG. 4B, by forming this projection 55, a first recessed area 50*b* is formed in front of the projection 55 in the pull-out direction and a second recessed area 50*c* is formed in back of the projection 55 in the pull-out direction. Meanwhile, while the second stacker 50 is being pulled out from the first stacker 40, the first projection 46 formed toward the front of the first stacker 40 passes over the projection 55 formed in the second stacker 50 from the first recessed area 50*b* and then fits with the second recessed area 50*c* located thereafter; this regulates the movement of the second stacker 50 in the push-in direction. Note that at this time, while the first projection 46 is passing over the projection 55, at least one of the first stacker 40 and the second stacker 50 bends, and once the first projection 46 has passed over the projection 55, that bending is restored to the original state.

Furthermore, while the second stacker 50 is being stored behind the rear surface of the first stacker 40, the second projection 47 formed toward the back of the first stacker 40 passes over the projection 55 formed in the second stacker 50 from the second recessed area 50*c* and then fits with the first recessed area 50*b* in front thereof; this regulates the movement of the second stacker 50 in the pull-out direction. Note that at this time, while the second projection 47 is passing over the projection 55, at least one of the first stacker 40 and the second stacker 50 bends, and once the second projection 47 has passed over the projection 55, that bending is restored to the original state.

As a result, a locking sound, or a "click", caused by the first projection 46 and the second projection 47 passing over the projection 55 and then interlocking with the first recessed area 50*b* or the second recessed area 50*c*, can be heard by a user when the user pulls out or pushes in the second stacker 50.

Figure 5C:
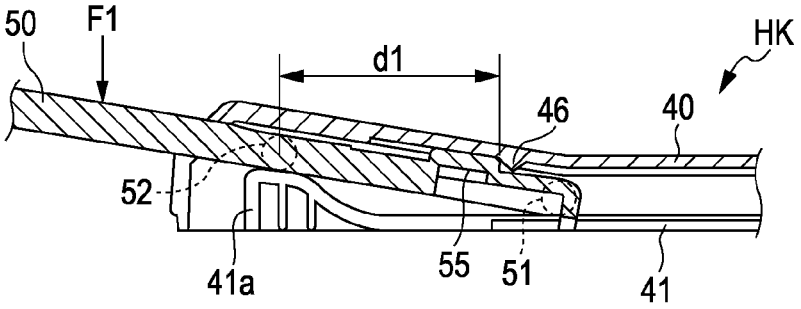
Figure 5D:
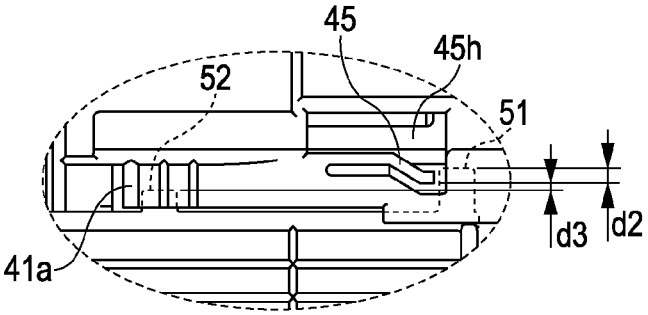

The configuration of the holding mechanism portion HK, which functions based on the manner in which the interlocking mechanism is formed in the first stacker 40 and the second stacker 50, will now be described with reference to FIGS. 5A to 5D. FIGS. 5A through 5D illustrate a state in which the second stacker 50 has been pulled out from the first stacker 40; FIG. 5A is a plan view of the stackers from above, FIG. 5B is a cross-sectional view taken along the VB-VB line in FIG. 5A, and FIG. 5C is a cross-sectional view taken along the VC-VC line illustrated in FIG. 5A. FIG. 5D is a partial bottom view seen from below of the oval dash-line area indicated by the arrow VD in FIG. 5A. Of these, FIGS. 5B and 5C in particular are diagrams illustrating the configuration of the holding mechanism portion HK.

As shown in FIGS. 5A through 5D, when pulled out, the movement of the second stacker 50 in the pull-out direction is regulated by the longer base end shaft-shaped projections 51 interlocking (making contact) in the pull-out direction with the leading ends of the contact portions 45 that face toward the back. At this time, as shown in FIG. 5B, the shorter leading end shaft-shaped projections 52 provided toward the front in the pull-out direction pass toward the front of the position in which the contact portions 45 are formed in the pull-out direction without interlocking with the contact portions 45, after which the base end shaft-shaped projections 51 make contact with the contact portions 45. The movement of the leading end shaft-shaped projections 52 is regulated by this contact, and in this state, the leading end shaft-shaped projections 52 are lifted upward by the sloped portions 41*s*, which function as support portions. Meanwhile, the movement of the base end shaft-shaped projections 51 in the upward direction is regulated by the guide surface 42, and the base end shaft-shaped projections 51 are positioned at the flat portion of the guide plates 41 so as not to be lifted upward. Accordingly, the forward end of the second stacker 50 in the pull-out direction is lifted upward relative to the first stacker 40, and the second support surface SP2 is held approximately parallel to the leading edge-side support surface SP1*b* in the first support surface SP1 of the first stacker 40. To rephrase, the sloped portions 41*s* are formed so that the second support surface SP2 is approximately parallel to the leading edge-side support surface SP1*b* in the first support surface SP1.

Note that the three reinforcing ribs 41*a* are provided below the sloped portions 41*s* as mentioned earlier, using the space created below the sloped portions 41*s* due to the lifting. As a result, as shown in FIG. 5B, even if a load F2 is exerted on the leading end shaft-shaped projections 52 due to a force F1 caused by the weight of the stacked paper P being exerted on the second stacker 50, in terms of strength, the first stacker 40 is capable of withstanding the load to a sufficient degree.

Furthermore, as shown in FIG. 5C, when the second stacker 50 has been pulled out, the projection 55 provided in the second stacker 50 makes contact and interlocks with the first projection 46 provided in the first stacker 40 from the forward side. As a result, the second stacker 50 is prevented from moving in the direction opposite to the pull-out direction, and is thus held in the pulled-out state.

Accordingly, as can be seen from FIGS. 5B and 5C, the holding mechanism portion HK is primarily configured of the guide plates 41 (sloped portions 41*s*), the guide surface 42, the contact portions 45, and the first projection 46 provided in the first stacker 40, and the base end shaft-shaped projections 51, the leading end shaft-shaped projections 52, and the projection 55 provided in the second stacker 50.

Here, in this embodiment, as shown in FIG. 5A, the projection 55 and the first projection 46 are formed so that the planar location at which those projections come into contact with each other is a location that is a predetermined distance d1 in the pull-out direction from the location of the center of the leading end shaft-shaped projections 52. Thus, as shown in FIG. 5C, when a force F1 has been exerted on the second support surface SP2 due to the weight of the stacked paper P, the projection 55 is raised upward with the leading end shaft-shaped projections 52 serving as the rotational center; therefore, the degree to which the projection 55 interlocks with the first projection 46 is increased.

In this manner, when a load is applied to the second stacker 50, such as in the case where a force F1 is exerted due to the stacked paper P, a certain load is exerted upon the base end shaft-shaped projections 51 and the leading end shaft-shaped projections 52. Accordingly, it is necessary for the guide rails 44 to be of a strength, at the area at which the base end shaft-shaped projections 51 and the leading end shaft-shaped projections 52 are located when the second stacker 50 has been pulled out, that can withstand the load placed thereupon through the base end shaft-shaped projections 51 and the leading end shaft-shaped projections 52.

Incidentally, in this embodiment, the areas of the guide rails 44 in which the contact portions 45, which are configured of elastic members, are located have a lower degree of mechanical strength. This is due to the contact portions 45 being formed as cuts in the guide ribs 43, which are constituent elements of the guide rails 44, as described above. In consideration of this, in this embodiment, the contact portions 45 regulate the movement of the second stacker 50 in the pull-out direction by interlocking with the longer base end shaft-shaped projections 51 toward the following side in the pull-out direction, and thus are located forward from the base end shaft-shaped projections 51 in the pull-out direction, as shown in FIGS. 5A and 5D. Accordingly, cuts are not formed in the guide rails 44 in the positions at which the base end shaft-shaped projections 51 are located. As a result, the guide rails 44 have a sufficient mechanical strength with respect to loads exerted thereon through the base end shaft-shaped projections 51.

Furthermore, because the shorter leading end shaft-shaped projections 52 that are located forward in the pull-out direction pass over the contact portions 45 without interlocking therewith, the contact portions 45 are located further backward in the pull-out direction than the leading end shaft-shaped projections 52. Accordingly, with respect to loads exerted through the leading end shaft-shaped projections 52, the guide rails 44 are capable of withstanding loads exerted thereupon through the leading end shaft-shaped projections 52 to a sufficient degree, due not only to no cuts being formed therein, but also due to the reinforcement provided by the reinforcing ribs 41*a* as described above.

It should be noted that in this embodiment, as shown in FIG. 5D, the contact portions 45 and the base end shaft-shaped projections 51 are set to interlock with each other by an amount (in FIG. 5D, a length d2) that takes into consideration of error in the dimensions of the first stacker 40 and the second stacker 50 in the width direction, so that the contact portions 45 and the base end shaft-shaped projections 51 interlock (make contact) with each other with certainty. Accordingly, in the case where, for example, the stacker 100 is assembled by first inserting the second stacker 50 into the first stacker 40 from the direction that is opposite to the pull-out direction (that is, by putting the second stacker 50 in the stored state), the contact portions 45, which are configured of elastic members, are set so as to be capable of flexing by a predetermined amount toward the die-cutting openings 45*h* (here, an amount equivalent to the length d2), so that the contact portions 45 can pass the base end shaft-shaped projections 51 in the push-in direction. Furthermore, the leading end shaft-shaped projections 52 are also set so as to be separated by an amount (in FIG. 5D, a length d3) that takes into consideration of error in the dimensions of the first stacker 40 and the second stacker 50 in the width direction, so that the leading end shaft-shaped projections 52 do not interlock (make contact) with the contact portions 45 when the second stacker 50 is pulled out.

According to the embodiment described thus far, the following effects can be achieved.

(1) The contact portions 45, which regulate the movement of the second stacker 50 in the pull-out direction by making contact with the base end shaft-shaped projections 51 without making contact with the leading end shaft-shaped projections 52 of the second stacker 50, are located between the base end shaft-shaped projections 51 and the leading end shaft-shaped projections 52 in the pull-out direction. Accordingly, when the second stacker 50 has been pulled out, the parts of the guide rails 44 that make contact with the leading end shaft-shaped projections 52 toward the front in the pull-out direction and the base end shaft-shaped projections 51 toward the rear in the pull-out direction, respectively, need not be flexible in order to bend upon making contact with the leading end shaft-shaped projections 52; this makes it possible for the guide rails 44 to have a strong resilience. As a result, it is possible to provide a stacker 100 that, in the case where the second stacker 50 takes on a heavy load, such as when paper P having a large size is supported, is suitable for withstanding a load in the gravitational direction that is exerted on the forward side of the leading end shaft-shaped projections 52 in the pull-out direction and the guide rails 44 that holds the leading end shaft-shaped projections 52.

(2) When the second stacker 50 has been pulled out from the first stacker 40, the second stacker 50 is held in a tilted orientation so that the leading end shaft-shaped projections 52 are positioned higher than the base end shaft-shaped projections 51, and thus the discharged paper P can be stacked in a stable manner.

(3) In the case where the second stacker 50 has taken on a load, a rotational force in the direction that increases the degree of interlock between the first projection 46 formed in the first stacker 40 and the second recessed area 50*c* formed in the second stacker 50 is applied, with the leading end shaft-shaped projections 52, which are forward in the pull-out direction, acting as the rotational center thereof. Accordingly, for example, even if there is a gap (looseness) between the shaft-shaped projections 51 and 52 and the guide rails 44, the degree of interlock will not decrease due to that gap; this makes it possible to maintain, in a stable manner, the tilted state of the second stacker 50 that has been pulled out from the first stacker 40.

(4) The first projection 46 and second projection 47, and the first recessed area 50*b* and second recessed area 50*c*, are formed in the central areas in the width direction of the first stacker 40 and the second stacker 50, which flex more easily than the ends thereof in the width direction. Accordingly, it is not necessary to, for example, form a separate hinge in the first support surface that enables the first projection 46 to flex more easily; this makes it possible to form the support surface SP1 in a shape that does not interfere with the movement of the discharged paper P. Furthermore, because the first projection (first interlocking portion) 46 and the projection (second interlocking portion) 55 interlock at the central area in the width direction, even if the second stacker 50 is pulled out from the first stacker 40 at a tilt during pull-out, a stable interlock can be achieved because the influence of the tilt at the central area in the width direction is low. Accordingly, the pull-out operation can be carried out in a smooth manner. Conversely, when pushing the second stacker 50 in, the interlock at the central area can be canceled with little influence by the tilt, and thus the push-in operation can be carried out in a smooth manner as well.

(5) By employing the stacker 100, in which the holding mechanism portion HK forms a mechanically strong support surface when the second stacker 50 has been pulled out of the first stacker 40, it is possible to provide the printer 11 that includes a recording medium stacker that has good load-bearing properties.

Second Embodiment

Next, a second embodiment will be described. In the first embodiment, in the case where the first stacker 40 is formed through, for example, resin material molding, it is easy for dimensional error to occur between the sloped portions 41*s* in the width direction, depending on the molding conditions, the properties of the resin material, and so on. Likewise, it is easy for dimensional error to occur in the width direction when forming the second stacker 50, due to the molding of the resin material. Incidentally, as described in the aforementioned first embodiment, the second stacker 50 is stored underneath the rear side of the first stacker 40 having been inserted between the sloped portions 41*s* of the right and left pair of guide plates 41 formed on both sides of the first stacker 40 in the width direction (horizontal direction) thereof. Accordingly, it is necessary to provide, between the first stacker 40 and the second stacker 50, a gap (looseness) in the width direction of a size that corresponds to this dimensional error. As a result, the second stacker 50 may lean relative to the first stacker 40 due to this gap.

Likewise, the second stacker 50 is stored by the base end shaft-shaped projections 51 on both sides in the width direction being inserted, in the push-in direction, between the guide ribs 43 formed on both sides of the first stacker 40 in the width direction. Accordingly, due to the dimensional error of the guide ribs 43 in the width direction created when forming the first stacker 40 and the dimensional error of the base end shaft-shaped projections 51 in the width direction (the direction in which the projections protrude) created when forming the second stacker 50, a gap (looseness) in the width direction equivalent to that error is created between the first stacker 40 and the second stacker 50. This gap may also cause the second stacker 50 to lean relative to the first stacker 40.

Figure 6A:
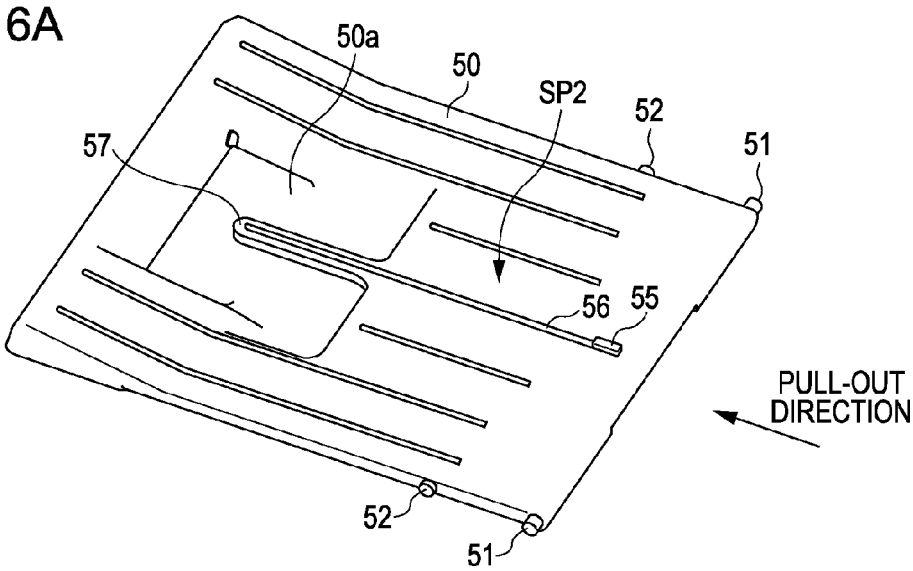
FIGS. 6A, 6B, and 6C are diagrams illustrating a stacker according to a second embodiment, where
Figure 6B:
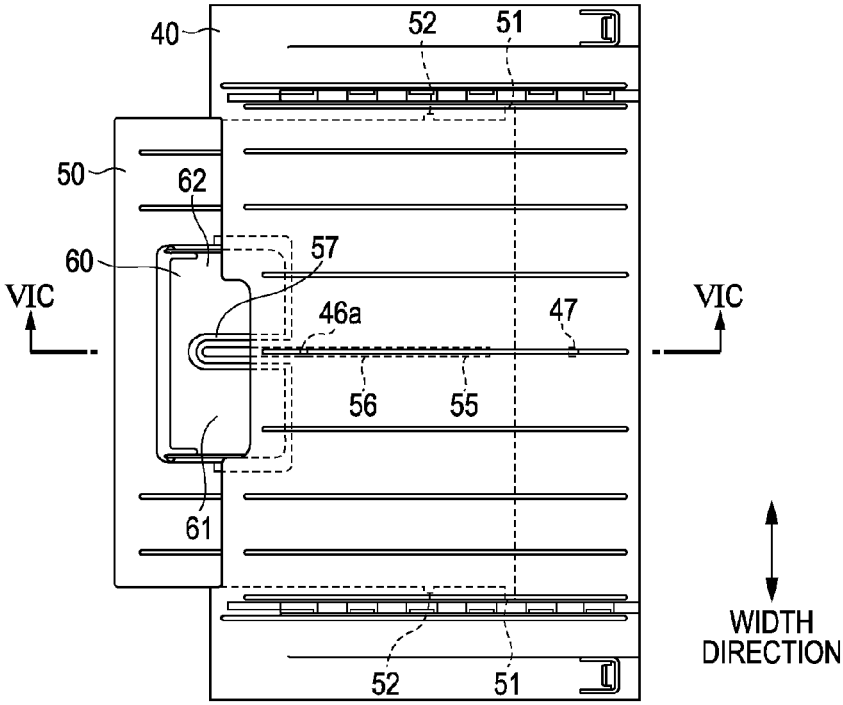
Figure 6C:
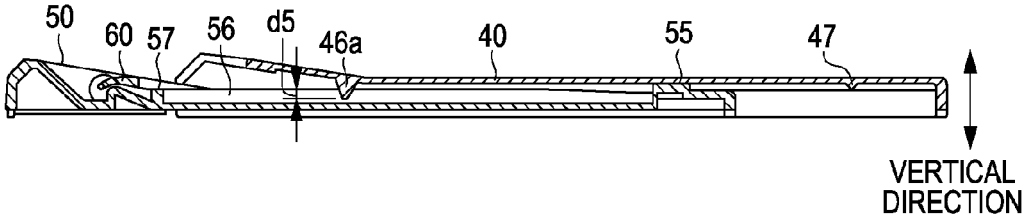

Accordingly, in this embodiment, the gap (looseness) between the first stacker 40 and the second stacker 50 in the width direction is reduced. This embodiment will now be described using FIGS. 6A through 6C. FIG. 6A is a perspective view illustrating the second stacker 50 at an angle from above. FIG. 6B is a plan view illustrating the stacker 100 from above. FIG. 6C is a cross-sectional view taken along the VIC-VIC line shown in FIG. 6B.

As shown in FIG. 6A, in the second stacker 50 according to this embodiment, an extension portion 57 is provided in the second support surface SP2, the extension portion 57 being provided with a predetermined width in the center of the width direction of the storage depression 50*a* in which the third stacker 60 is stored and extending in the pull-out direction. In the center of the second support surface SP2 that includes the extension portion 57, a band-shaped groove 56 that extends lengthwise along the pull-out direction is provided adjacent to the projection 55.

FIG. 6B illustrates a state in which the second stacker 50, in which the groove 56 is provided, has been pulled out partway from the first stacker 40 (to rephrase, is partway pushed in). As shown in FIG. 6B, a first projection 46*a* corresponding to the first projection 46 of the first embodiment is provided in the first stacker 40. Furthermore, in this embodiment, the first projection 46*a* is capable of sliding into the groove 56 provided in the second stacker 50. Moreover, as shown in FIG. 6C, the first projection 46*a* according to this embodiment extends longer downward than the first projection 46 of the first embodiment, and interlocks with the groove 56 to a predetermined degree (here, equivalent to a depth d5) in the downward direction. In other words, in this embodiment, the first projection 46*a* is capable of sliding into the groove 56 provided in the second stacker 50 from when the pull-out operation has been started to when the projection 55 is interlocked with the first projection 46*a*. Therefore, according to this embodiment, the gap between the first stacker 40 and the second stacker 50 in the width direction is a gap whose size is determined only by the dimensional error of the first projection 46*a* in the width direction and the dimensional error of the groove 56 in the width direction.

Note that when the second stacker 50 has been pulled out, the first projection 46*a* bends more than the first projection 46 of the first embodiment when passing over the projection 55; however, as stated above, the first projection 46*a* is formed in the central area in the width direction and can therefore bend without any problem. Furthermore, as shown in FIG. 6B, a cutout is formed in the third stacker 60 in essentially the center thereof in the width direction so that, when the third stacker 60 is stored in the second stacker 50, the third stacker 60 is distanced from and does not interlock with the extension portion 57 in a planar manner.

According to the second embodiment described thus far, the following effects can be achieved in addition to the effects (1) through (5) of the aforementioned first embodiment.

(6) The movement of the second stacker 50 in the width direction relative to the first stacker 40 is regulated by the first projection 46*a* interlocking tightly with the groove 56 during the pull-out and push-in of the second stacker 50. Accordingly, looseness in the width direction occurring when the second stacker 50 is pulled out or pushed in can be suppressed, which makes it possible to pull out or push in the second stacker 50 in a smooth manner.

The aforementioned embodiments may be changed to the embodiments described hereinafter as well.

In the aforementioned embodiments, the base end shaft-shaped projections 51 and the leading end shaft-shaped projections 52 have column shapes whose cross-sections are circular, as shown in, for example, FIG. 4; however, these projections do not necessarily have to have such a shape. For example, the cross-sections thereof may be any shape, such as square, elliptical, or the like. Alternatively, the cross-sections may have a hollow box-shape. In sum, these projections may have any shape as long as the shape is capable of sliding along the guide rails 44 when the second stacker 50 is pulled out and can sufficiently withstand a load.

In the aforementioned embodiments, it is not absolutely necessary for the position at which the first projection 46 and the projection 55 interlock to be further backward in the pull-out direction than the leading end shaft-shaped projections 52. This position may be, for example, the same position as the leading end shaft-shaped projections 52, or may be further forward in the pull-out direction than the leading end shaft-shaped projections 52, as long as it is a position in which an interlock between the first projection 46 and the projection 55 can be ensured.

In the aforementioned embodiments, it is not absolutely necessary for the first projection 46 or the second projection 47 to be formed in the central area in the width direction of the first stacker 40. Accordingly, the projection 55 also need not be formed in the central area in the width direction of the second stacker 50. Any positions may be used as long as they ensure that the first projection 46 or the second projection 47 can bend when interlocking with the projection 55 in a planar manner.

Furthermore, the first projection 46 or the second projection 47 may be provided in multiple. Accordingly, the projection 55 may be provided in multiple as well. In this case, the projections may be provided so that their positions are skewed from each other in the pull-out direction. Doing so makes it possible to obtain a "clicking" feel at multiple locations when pulling the second stacker 50 out from the first stacker 40, and makes it possible to stop the pull-out of the second stacker 50 with ease at the locations where the "clicking" feel occurs; this in turn makes it possible to, for example, easily adjust the size of the surface area to a desired size.

In the aforementioned embodiments, it is not absolutely necessary for the contact portions 45 to be provided as flexible elastic portions. For example, it is not necessary for the contact portions 45 to be flexible in the case where the configuration is such that the second stacker 50 is first inserted into the first stacker 40 in the pull-out direction when assembling the stacker 100, an assembly configuration in which the second stacker 50 is not first inserted in the opposite direction as the pull-out direction, and so on.

In the aforementioned embodiments, it is not absolutely necessary for the second support surface SP2 to be in a tilt state more upward from the base-side support surface SP1*a* of the first support surface SP1 relative to the pull-out direction when the second stacker 50 has been pulled out from the first stacker 40. For example, the configuration may be such that the base-side support surface SP1*a* and the leading edge-side support surface SP1*b* of the first support surface SP1 in the first stacker 40 are approximately parallel with the second support surface SP2 of the second stacker 50. In this case, the reinforcing ribs 41*a* are not formed below the leading end shaft-shaped projections 52, but there is no problem as long as the guide rails 44 have good load-bearing properties.

In the aforementioned embodiments, the stacker may be a recording medium stacker that includes multiple stack members having the configurations of the first stacker 40 and the second stacker 50. For example, the structural relationship between the second stacker 50 and the third stacker 60 can be set to the same configuration as the structural relationship between the first stacker 40 and the second stacker 50 as described above.

In the aforementioned embodiments, the first stacker 40, the second stacker 50, and the third stacker 60 may be configured through integral molding using a resin material. Alternatively, the stackers may be formed by connecting multiple resin members using adhesive, screws, or the like, rather than being configured in an integral manner.

In addition, the material is not limited to resin, and may instead be metal. Alternatively, these materials may be used in combination with each other.

In the aforementioned embodiments, the recording apparatus may be a laser printer, a direct thermal printer, or the like, rather than an ink jet printer.

In addition, although the paper P is used as the recording medium in the aforementioned embodiments, the recording medium is not particularly limited to the paper P; any material, such as a resin plate, a metal plate, or the like, may be used as the recording medium as long as it is a medium that can be stacked in the recording medium stacker.

Although the recording apparatus is embodied as an ink jet printer 11 in the aforementioned embodiments, a liquid ejecting apparatus that ejects or discharges a liquid aside from ink may be employed as the recording apparatus. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid phase, including liquids having high or low viscosity, sol, gel water, other inorganic agents, organic agents, liquid solutions, liquid resins, and fluid states such as liquid metals (metallic melts); furthermore, in addition to liquids as a single state of a matter, liquids in which the particles of a functional material composed of a solid matter such as pigments, metal particles, or the like are dissolved, dispersed, or mixed in a solvent are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface light emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatuses that eject an etching liquid such as an acid or alkali onto a substrate or the like for etching. The invention can be applied to any type of these liquid ejecting apparatuses.

What is claimed is:

1. A recording medium stacker that supports and stacks a recording medium discharged from a recording apparatus, the stacker comprising:

a first stack member provided with a first support surface capable of supporting the recording medium; and a second stack member that is stored within the first stack member and can be pulled out of and pushed into the first stack member, and that is provided with a second support surface capable of supporting the recording medium when the second stack member has been pulled out of the first stack member and is in use, wherein the second stack member includes, on both side surfaces in the width direction that is the direction that intersects with the pull-out direction from the first stack member and follows the second support surface:

base-end projection portions, provided in the side surfaces, that protrude from the base end in the pull-out direction of the second stack member outward in the width direction; and leading-end projection portions, provided further toward the leading end of the second stack member in the pull-out direction than the base-end projection portions, that protrude outward in the width direction at a shorter length than the base-end projection portions, and the first stack member includes:

guide rails along which the projection portions slide during the pull-out;

contact portions that allow the leading-end projection portions to pass during the pull-out but prevent the passage of the base-end projection portions; and a support portion that supports the leading-end projection portions when the base-end projection portions have made contact with the contact portions.

2. The recording medium stacker according to claim 1, wherein the support portion is a sloped surface that guides the leading-end projection portions to a higher position in the gravitational direction than the base-end projection portions when the base-end projection portions have made contact with the contact portions.

3. The recording medium stacker according to claim 1, wherein a first interlocking portion is provided in the first stack member on the side thereof opposite to the first support surface;

a second interlocking portion capable of interlocking with the first interlocking portion is provided in the second support surface of the second stack member; and in the state where the movement of the second stack member in the pull-out direction is prevented by the base-end projection portions making contact with the contact portions, the interlocking portions interlock at a location that is closer to the base end in the pull-out direction than the leading-end projection portions so that the movement of the second stack member in the push-in direction is prevented.

4. The recording medium stacker according to claim 3, wherein the first interlocking portion is provided in the central area in the width direction of the first support surface; and the second interlocking portion is provided in the central area in the width direction of the second support surface.

5. The recording medium stacker according to claim 3, wherein a groove extending lengthwise in the pull-out direction is provided in the second support surface of the second stack member;

a protrusion capable of sliding along the groove is provided in the first stack member, in a location thereof that corresponds to the location of the groove in the width direction; and during the pull-out and the push-in, the second stack member moves while the protrusion is slid along the groove.

6. A recording apparatus comprising:

a recording unit that records onto a recording medium;

a discharge unit that discharges the recording medium that has been recorded onto; and the recording medium stacker according to claim 1.

* * * * *